US007032249B2

(12) United States Patent
Smith

(10) Patent No.: US 7,032,249 B2
(45) Date of Patent: Apr. 25, 2006

(54) UNISEX ACTIVE WEAR GARMENT WITH MODIFIED FLY-FLAP AND STORAGE POCKETS

(76) Inventor: Betty H. Smith, 13412 Dowlais Dr., Rockville, MD (US) 20853

( * ) Notice: Subject to any disclaimer, the term of this patent is extended or adjusted under 35 U.S.C. 154(b) by 141 days.

(21) Appl. No.: 10/663,750

(22) Filed: Sep. 17, 2003

(65) Prior Publication Data

US 2005/0055755 A1 Mar. 17, 2005

(51) Int. Cl.
*A41B 9/00* (2006.01)

(52) U.S. Cl. ..... 2/78.2; 2/408; 2/404; 2/407

(58) Field of Classification Search ..... 2/69, 2/73, 80, 83, 109, 234, 78.1–78.4, 400–409, 2/227, 228, 238, 235, 247, 253, 912; 450/102–105
See application file for complete search history.

(56) References Cited

U.S. PATENT DOCUMENTS

| | | | | |
|---|---|---|---|---|
| 602,188 | A | 4/1898 | Sittig | |
| 1,083,712 | A | 1/1914 | Uyeda | |
| 1,596,681 | A * | 8/1926 | Newman | 2/78.2 |
| 1,987,369 | A * | 1/1935 | O'Shea | 602/67 |
| 2,016,990 | A | 10/1935 | Davis | |
| 2,389,273 | A | 11/1945 | Novak | |
| 2,396,599 | A | 3/1946 | O'Brien | |
| 2,477,593 | A | 8/1949 | Gershenow | |
| 2,544,840 | A * | 3/1951 | Kowatsch | 2/67 |
| 2,896,633 | A | 7/1959 | McKee | |
| 3,020,556 | A | 2/1962 | Isley | |
| 3,279,469 | A | 10/1966 | Schustack | |
| 3,425,063 | A | 2/1969 | Brown | |
| 3,788,314 | A * | 1/1974 | Noreen | 602/67 |
| 3,840,901 | A * | 10/1974 | Eyster | 2/247 |
| 3,974,836 | A | 8/1976 | Carlson | |
| 4,035,844 | A * | 7/1977 | Atack et al. | 2/466 |
| 4,280,230 | A | 7/1981 | LaFleur | |
| 4,389,733 | A * | 6/1983 | Boykins, Jr. | 2/466 |
| 4,389,801 | A * | 6/1983 | Sharrock et al. | 40/775 |
| 4,578,828 | A | 4/1986 | Smith, Sr. et al. | |
| 4,604,761 | A | 8/1986 | Wright | |
| 4,619,004 | A * | 10/1986 | Won | 2/227 |
| 4,637,078 | A | 1/1987 | Southwell | |
| 4,805,243 | A * | 2/1989 | Gibbens et al. | 2/228 |
| 4,807,304 | A | 2/1989 | McCants-Reed | |
| 4,835,795 | A * | 6/1989 | Lonon | 2/408 |
| 4,951,321 | A | 8/1990 | Mortensen et al. | |
| 4,961,234 | A | 10/1990 | Leibman | |
| 5,010,595 | A | 4/1991 | Stradley | |
| 5,067,178 | A | 11/1991 | Katchka | |
| 5,074,854 | A | 12/1991 | Davis | |

(Continued)

FOREIGN PATENT DOCUMENTS

| | | |
|---|---|---|
| JP | 2002-186642 | 12/1991 |

*Primary Examiner*—Alissa L. Hoey
(74) *Attorney, Agent, or Firm*—Richard C. Litman

(57) ABSTRACT

The unisex active wear garment with modified fly-flap and storage pockets is a pair of shorts or pants for the lower body having a crotch opening covered by a completely removable or partially openable pocketed fly-flap. The crotch opening is designed to expose both the male anatomy and female anatomy. The wearer either partially removes or completely removes the fly-flap from the crotch opening to modestly perform bodily functions without having to entirely disrobe. Pockets on the fly-flap allow the wearer to carry necessities such as toiletries or key.

17 Claims, 8 Drawing Sheets

U.S. PATENT DOCUMENTS 5,093,935 A 3/1992 Countee, Jr.
5,172,430 A 12/1992 Lerma-Solis
D339,219 S 9/1993 Beauchemin
D341,470 S 11/1993 Quick
5,341,515 A 8/1994 Cohen
5,535,452 A * 7/1996 Rozenblat ..... 2/403
5,539,926 A 7/1996 Mantos
5,636,387 A * 6/1997 Lundy ..... 2/408
5,713,081 A * 2/1998 Pappas et al. ..... 2/409
D396,542 S 8/1998 Nicholson
5,809,576 A * 9/1998 Huston et al. ..... 2/247
5,822,793 A 10/1998 Tokura et al.
5,878,441 A * 3/1999 Busker et al. ..... 2/247
5,930,838 A 8/1999 Carter-Scott-Pomije
6,018,823 A 2/2000 Ortmeier
6,192,522 B1 2/2001 Schreib
6,243,878 B1 * 6/2001 Khemka et al. ..... 2/227
6,324,699 B1 12/2001 Cosmah
6,412,119 B1 7/2002 Robles
6,457,185 B1 * 10/2002 Frazier ..... 2/239
6,460,186 B1 10/2002 Dailly
6,477,711 B1 11/2002 Freeman et al.

* cited by examiner

UNISEX ACTIVE WEAR GARMENT WITH MODIFIED FLY-FLAP AND STORAGE POCKETS

BACKGROUND OF THE INVENTION

1. Field of the Invention

The present invention relates to apparel for the lower body, more particularly, a pair of shorts or pants having an opening in the crotch area covered by a completely removable or partially removable pocketed flap.

2. Description of the Related Art

Athletes of all sports, such as runners, skiers, skaters, walkers, bicyclers, or swimmers, have little time to waste when in the heat of competition. Winning or losing depends on time and performance. Athletes, however, cannot avoid taking time out of racing to perform normal bodily functions, such as urination or defecation. The time needed to perform these bodily functions can be unnecessarily prolonged due to the nature of the sport. For example, in the course of competition athletes may not be able to find a discrete area in which to carry out bodily functions. The delay may be further prolonged due to the nature of the apparel usually worn by participants in the sport.

For example, runners and joggers often wear active wear running togs made from spandex or other elastic fabric. During marathon runs or long workouts on park trails, nature sometimes calls, and the active wear can be difficult or uncomfortable to pull down and pull up over the hips, since the clothing is often damp and heavy with perspiration. Typically the athlete desires a quick way of opening the clothing just enough to eliminate bodily waste, so that they can resume their run as quickly as possible. Though performing normal bodily functions cannot be avoided, modifying the apparel worn by the athlete can drastically reduce the time needed to perform these functions. A number of garments have been proposed to allow the wearer to perform bodily functions without having to disrobe.

U.S. Pat. No. 5,930,838, issued to Carter-Scott-Pomije on Aug. 3, 1999, describes pull-on pants or shorts having a flapped opening for the female anatomy. A pocket is provided on the leg panel to hold small items, such as tissue paper. U.S. Pat. No. 5,341,515, issued to Cohen on Aug. 30, 1994, describes a medical examination garment possessing an opening between the legs extending from front to back. A rear flap attached to the rear of the garment and a front flap attached to the front of the garment covers the crotch opening. The flaps either individually or simultaneously are lifted from the garment to expose the genital area.

Sportswear having flapped openings at the crotch are described in U.S. Pat. No. 3,020,556, issued to Isley on Feb. 13, 1962 (men's tights with front flap over pubic region); U.S. Pat. No. 6,460,186, issued to Dailly on Oct. 8, 2002 (male-specific cyclist sportswear with front opening having an external flap and an internal flap over the pubic region to facilitate urination); and U.S. Pat. No. 5,539,926, issued to Mantos on Jul. 30, 1996 (sport trouser having a padded triangular fly-flap removably secured over the pubic region).

Still other patents showing outerwear designed with an exposable crotch area include U.S. Pat. No. 4,961,234, issued to Leibman on Oct. 9, 1990 (outergarment with detachable multilayered crotch piece having a disposable inner liner and a washable outer portion); U.S. Pat. No. 4,604,761, issued to Wright on Aug. 12, 1986 (woman's outergarment with front flap extending from waistline to crotch region); U.S. Pat. No. 6,192,522, issued to Schreib on Feb. 27, 2001 (pants with removable crotch flap to facilitate urination by females); U.S. Pat. No. 5,822,793, issued to Tokura et al. on Oct. 20, 1998 (clothing with an envelope-like flap covering a crotch opening); U.S. Pat. No. 5,010,595, issued to Stradley on Apr. 30, 1991 (woman's trousers having a releasable seam at the crotch and seat portion); U.S. Pat. No. 4,578,828, issued to Smith, Sr. et al on Apr. 1, 1986 (woman's pants with padded fly for covering a crotch-opening extending from the rear of the garment to the front of the garment); U.S. Pat. No. 3,425,063, issued to Brown on Feb. 4, 1969 (outergarment having a zippered crotch area attached to an undergarment); U.S. Pat. No. 2,389,273, issued to Novak on Nov. 20, 1945 (slacks with drop seat); and U.S. Pat. No. 6,477,711, issued to Freeman et al. on Nov. 12, 2002 (unitary garment with buttock flap).

Undergarments with completely removable crotch pieces are described in U.S. Pat. No. 2,396,599, issued to O'Brien on Mar. 12, 1946 (undergarment with detachable crotch portion); U.S. Pat. No. 2,016,990, issued to Davis on Oct. 8, 1935 (girdle with detachable crotch portion); U.S. Pat. No. 4,280,230, issued to LaFleur on Jul. 28, 1981 (disposable training pants with cut-away crotch portion); U.S. Pat. No. 1,083,712, issued to Uyveda on Jan. 6, 1914 (undergarment having detachable sanitary piece); Japanese Patent Number 2002-186,642 published on Dec. 24, 1991 and U.S. Pat. No. 5,074,854, issued on Dec. 24, 1991 both to Davis (disposable undergarment with tear-away crotch portion); and U.S. Pat. No. 2,477,593, issued to Gershenow on Aug. 2, 1949 (panty girdle with detachable and replaceable crotch portion).

Undergarments with a partially removable crotch flap covering a crotch opening include U.S. Pat. No. 6,412,119, issued to Robles on Jul. 2, 2002 (undergarment with a forward flap); U.S. Pat. No. 4,951,321, issued to Mortensen et al. on Aug. 28, 1990 (undergarment with rear and front panels to cover crotch region); U.S. Pat. No. 3,974,836, issued to Carlson on Aug. 17, 1976 (girdle with panel affixed to rear of garment); U.S. Pat. No. 3,279,469, issued to Schustack on Oct. 18, 1966 (foundation garment with crotch panel secured to rear of garment); U.S. Pat. No. 4,637,078, issued to Southwell on Jan. 20, 1987 (undergarment with waterproof flap secured to rear of garment); U.S. Pat. No. 2,896,633, issued to McKee on Jul. 28, 1959 (garment with crotch piece secured to back of garment); and U.S. Pat. No. 602,188, issued to Sittig on (trunk with a flap covering a crotch opening).

Pantyhose having an easily accessible crotch area are disclosed in U.S. Pat. No. 6,324,699, issued to Cosmah on Dec. 4, 2001 (pantyhose with forward opening crotch flap fixedly secured to the front of pantyhose); and U.S. Pat. No. 4,807,304, issued to McCants-Reed on Feb. 28, 1989 (men's pantyhose having front flap to expose front of torso and rear flap to expose rear of torso).

Undergarments with pockets are shown in U.S. Pat. No. 6,018,823, issued to Ortmeier on Feb. 1, 2000; U.S. Design Pat. No. 396,542, issued to Nicholson on Aug. 4, 1998; U.S. Pat. No. 5,093,935, issued to Countee, Jr. on Mar. 10, 1992; U.S. Design Pat. No. 339,219, issued to Beauchemin on Sep. 14, 1993; U.S. Pat. No. 5,172,430, issued to Lerma-Solis on Dec. 22, 1992; U.S. Design Pat. No. 341,470, issued to Quick on Nov. 23, 1993; and U.S. Pat. No. 5,067,178, issued to Katchka on Nov. 26, 1991.

None of the above inventions and patents, taken either singly or in combination, is seen to describe the instant invention as claimed. Thus a unisex active wear garment with modified fly-flap and storage pockets solving the aforementioned problems is desired.

SUMMARY OF THE INVENTION

The unisex active wear garment with modified fly-flap and storage pockets is a pair of shorts or pants having a crotch opening covered by a completely removable or partially removable fly-flap having one or more pockets disposed thereon. The crotch opening is designed for use by either a male or female user. The wearer either partially or completely removes the fly-flap from the crotch opening to modestly perform bodily functions without entirely disrobing. Pockets found on the fly-flap allow the wearer to carry necessities such as toiletries, snacks or keys.

Accordingly, it is a principal object of the invention to provide a garment having a crotch opening suitable for either male or female users.

It is another object of the invention to provide a garment having a crotch opening covered by a removable fly-flap for allowing the wearer to perform bodily functions.

It is a further object of the invention to provide a garment having a crotch opening covered by a removable fly-flap for allowing the wearer to perform bodily functions without having to completely disrobe.

Still another object of the invention is to provide a garment having pockets on a removable fly-flap to hold small items.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
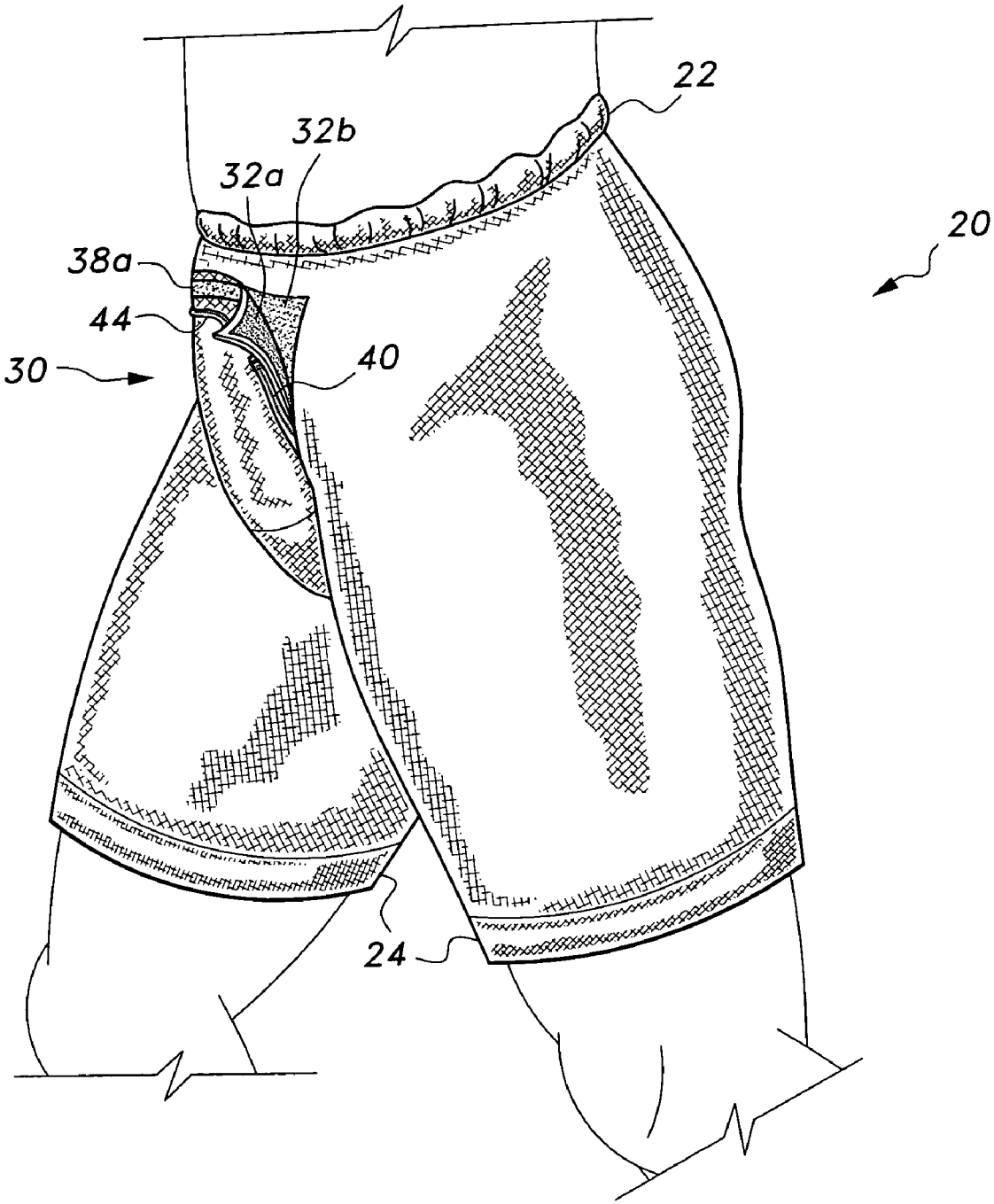
FIG. 1 is an environmental, perspective view of a unisex active wear garment with modified fly-flap and storage pockets according to the present invention, a corner of the flap being partially open.

The present invention is a unisex active wear garment with modified fly-flap and storage pockets, designated generally as 20 in FIGS. 1–4. The garment 20 is shown in FIG. 1 as a pair of shorts extending to about mid-thigh. However it will be understood that the scope of the present invention extends to active wear shorts or pants of any length adapted for being worn on the lower body, including short-shorts, mid-thigh shorts, knee-high shorts, calf-length pants, and long pants. The garment 20 can be constructed from a single type of fabric, or from fabric blends, or from several pieces of material of different fabric types, such as cotton, spandex, nylon, polyester, and blends of the above.

The garment 20 has an elastic waistband 22 sewn into a seam at the top of the garment 20 to encircle the waist and retain the garment 20 on the wearer's body, two legs 24 extending from the torso section and defining leg openings at the bottom of the garment 20, and a crotch opening disposed between the legs that is covered by a fly-flap 30 having pockets 40 and 44 disposed thereon. As described more fully below, pocket 40 opens laterally, while pocket 44 opens at the top of the flap 30. The garment 20 is pulled on the body in the usual manner one's legs through the legs 24 of the garment 20 and stretching the garment 20 up over the lower torso to encircle the waist.

The torso and leg sections of the garment 20 may be formed in a variety of ways, e.g., the garment 20 may be formed by a left panel and a right panel joined by front and rear seams and by inseams along the left and right legs 24, the rear of the flap 30 being stitched to the seat of the pants in the crotch area, as described below. Alternatively, the left and right panels may be further formed by front and rear portions joined by a side seam, so that the garment comprises left front, left rear, right front, and right rear panels, in addition to flap 30. Still further, instead of left and right panels, in some embodiments the garment 20 may be formed solely by front and back panels, together with the flap 30 covering the crotch area as described below.

Figure 2:
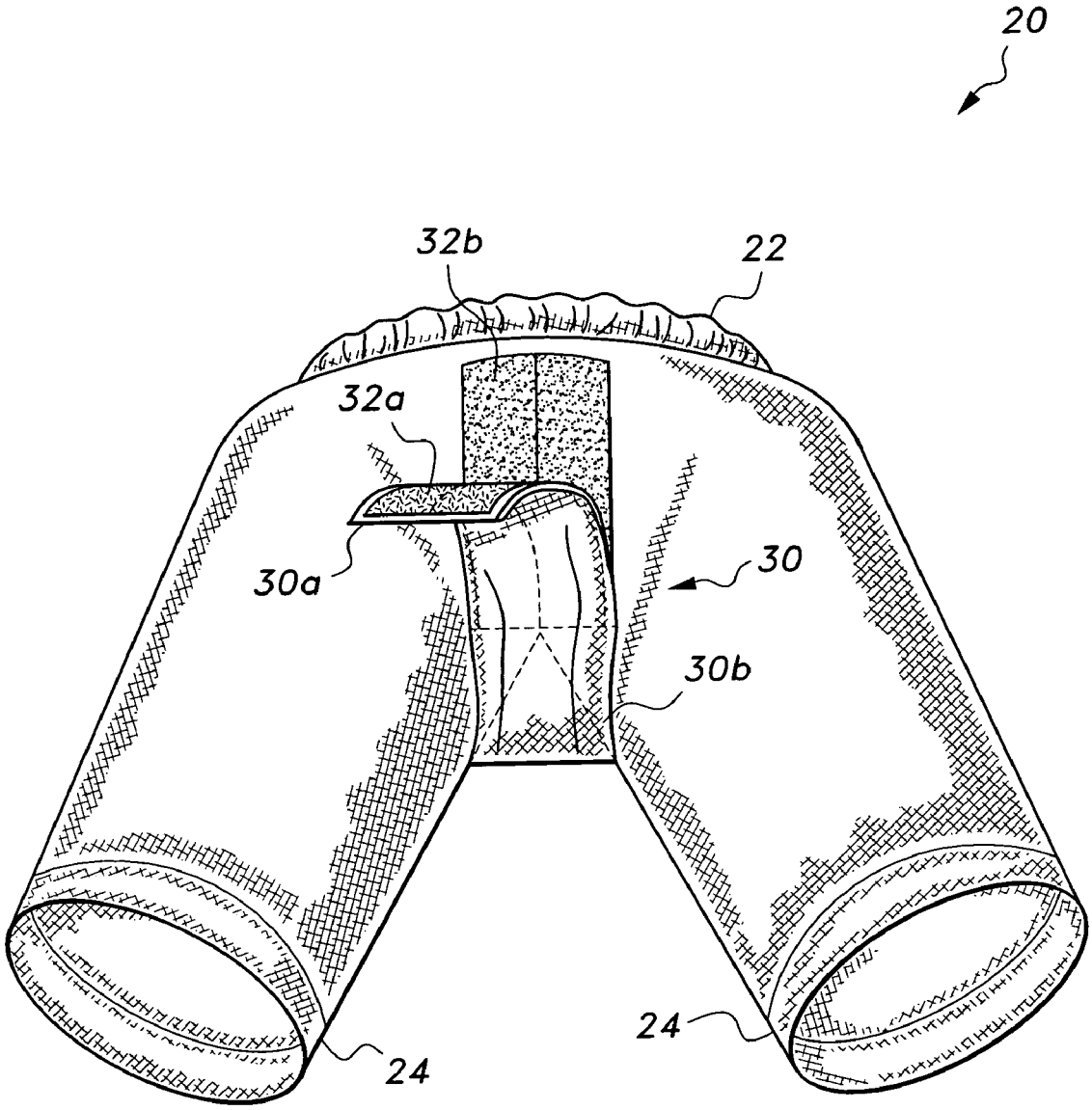
FIG. 2 is a front perspective view of the unisex active wear garment with modified fly-flap and storage pockets according to the present invention with one end of the fly-flap partially removed from the garment.

FIG. 2 shows the front of the active wear garment 20 with the fly-flap 30 partially removed from the garment. Fly-flap 30 comprises an elongated strip or panel of fabric having a substantially rectangular upper end 30*a* and a lower end 30*b* tapering to a generally triangular point (shown in shadow in FIG. 2). The lower end 30*b* of the fly-flap 30 is fixed to the rear seat of the garment 20 by sewing. The upper end 30*a* of the fly-flap 30 is releasably secured to the front of the garment 20 between about ½" to one inch below the waistband 22 by mating fasteners 32*a*, 32*b*. Fastener 32*b* is positioned on the exterior-front of the garment 20 between the waistband 22 and the crotch opening to engage fastener 32*a* positioned on the interior side of fly-flap 30. Mating fasteners 32*a*, 32*b* are preferably a hook and loop material, but can also be snap members or buttons.

Figure 3:
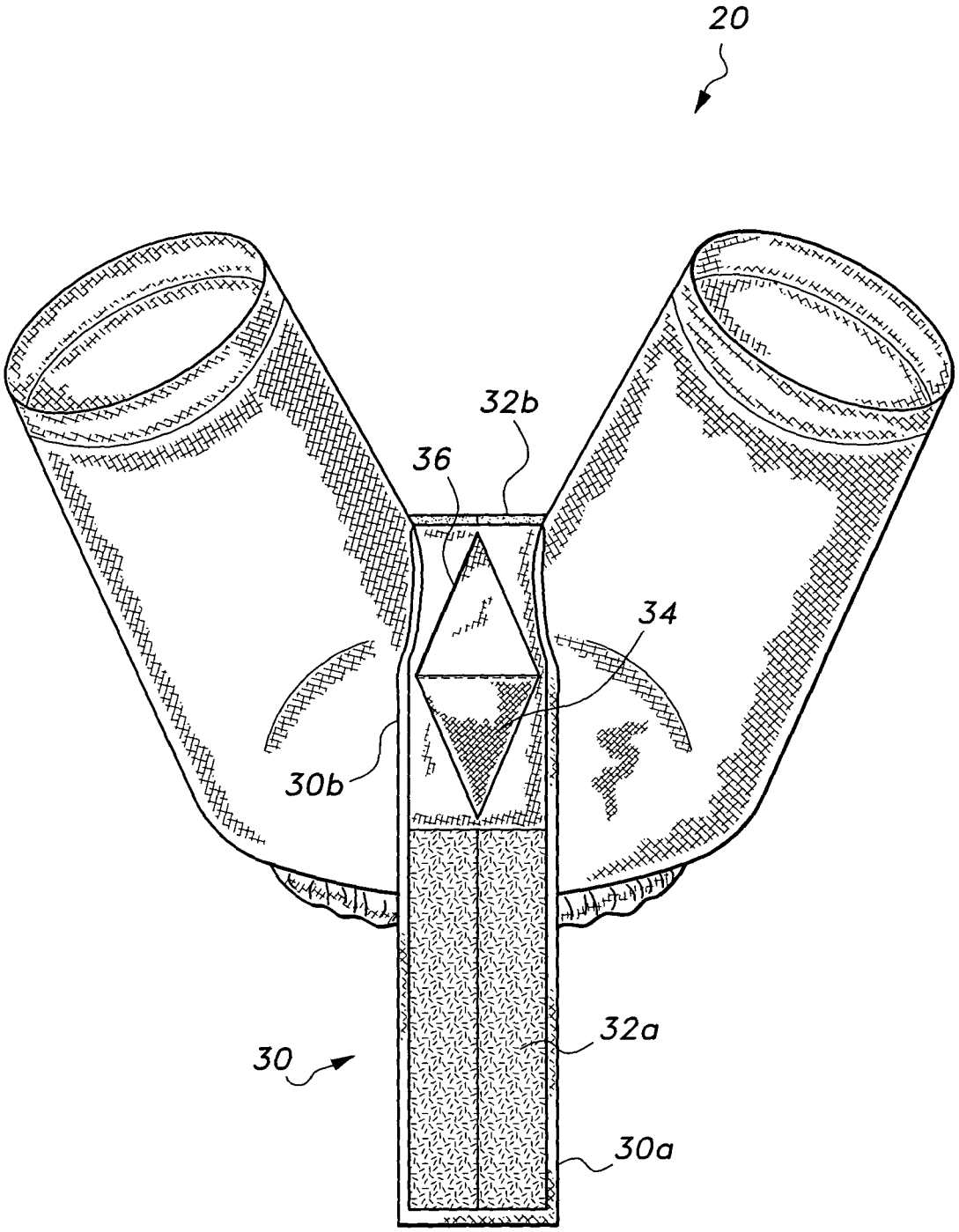
FIG. 3 is a bottom perspective view of the unisex active wear garment with modified fly-flap and storage pockets according to the present invention in an open configuration.

FIG. 3 displays the underside of garment 20 as seen from the rear with the fly-flap 30 being fully retracted from the garment 20 and drawn rearward to expose crotch opening 36. Crotch opening 36 is positioned to align with the genitalia of the wearer, and extends sufficiently high up the front side of the garment 20 to fully expose the penis or vulva, respectively, to permit quick access, forming an inverted V-shaped opening 36. A liner 34 is fixed to the interior side of the fixed end of the fly-flap 30*b*, and is shaped and dimensioned to cover opening 36 when fly-flap 30 is in the closed position, thereby overlying the pubic area. The liner 34 is moisture absorptive and, therefore, permits the wearer to wear garment 20 by itself, both as an outer-garment and an undergarment. Fastener 32*a* is attached to the interior surface of the fly-flap, and extends from the liner 34 to the upper end 30*a* of the fly-flap 30.

Figure 4:
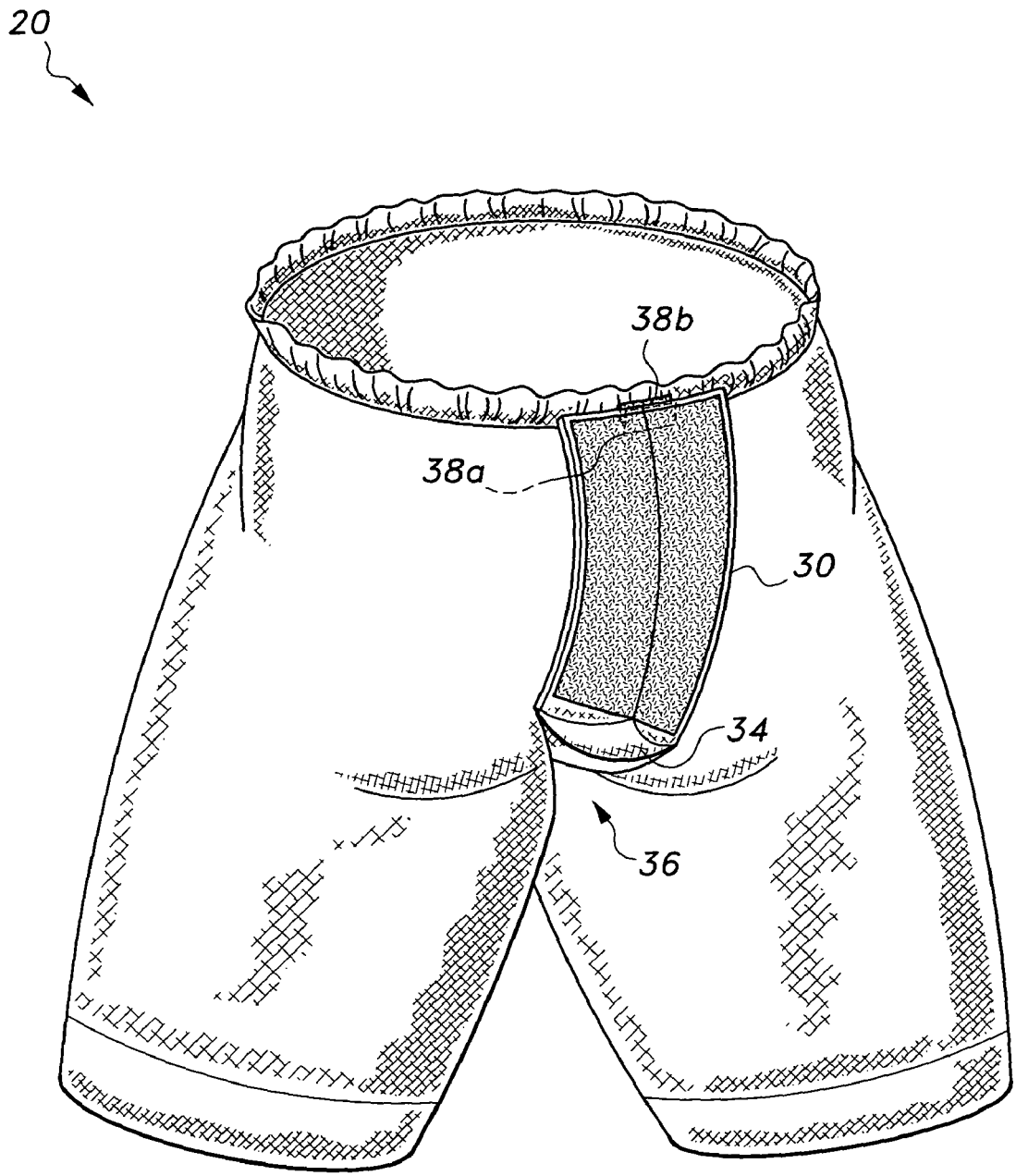
FIG. 4 is a rear perspective view of the unisex active wear garment with modified fly-flap and storage pockets according to the present invention with the fly-flap temporarily attached to the rear of the garment in an open configuration.

The crotch opening 36 is suitable for both the male anatomy and the female anatomy and permits the wearer to urinate or defecate modestly without disrobing. To perform either bodily function, the wearer pulls the fly-flap 30 away from the front of the garment, disengaging fastener 32*a* from fastener 32*b*, and drags the fly-flap down between the legs and back up to the rear of the garment to expose the pubic and perianal area. As shown in FIG. 4, fly-flap 30 is held in the open position by engaging fastener 38*a*, which is attached to the exterior side of fly-flap 30, as shown in FIG. 1, to the fastener 38*b* found on the waistband. Fastener 38*b* can be located anywhere along the rear of the garment to maintain the fly-flap in an open position. Preferably, fasteners 38*a* and 38*b* comprise mating patches of hook and loop fastening material.

Figure 5:
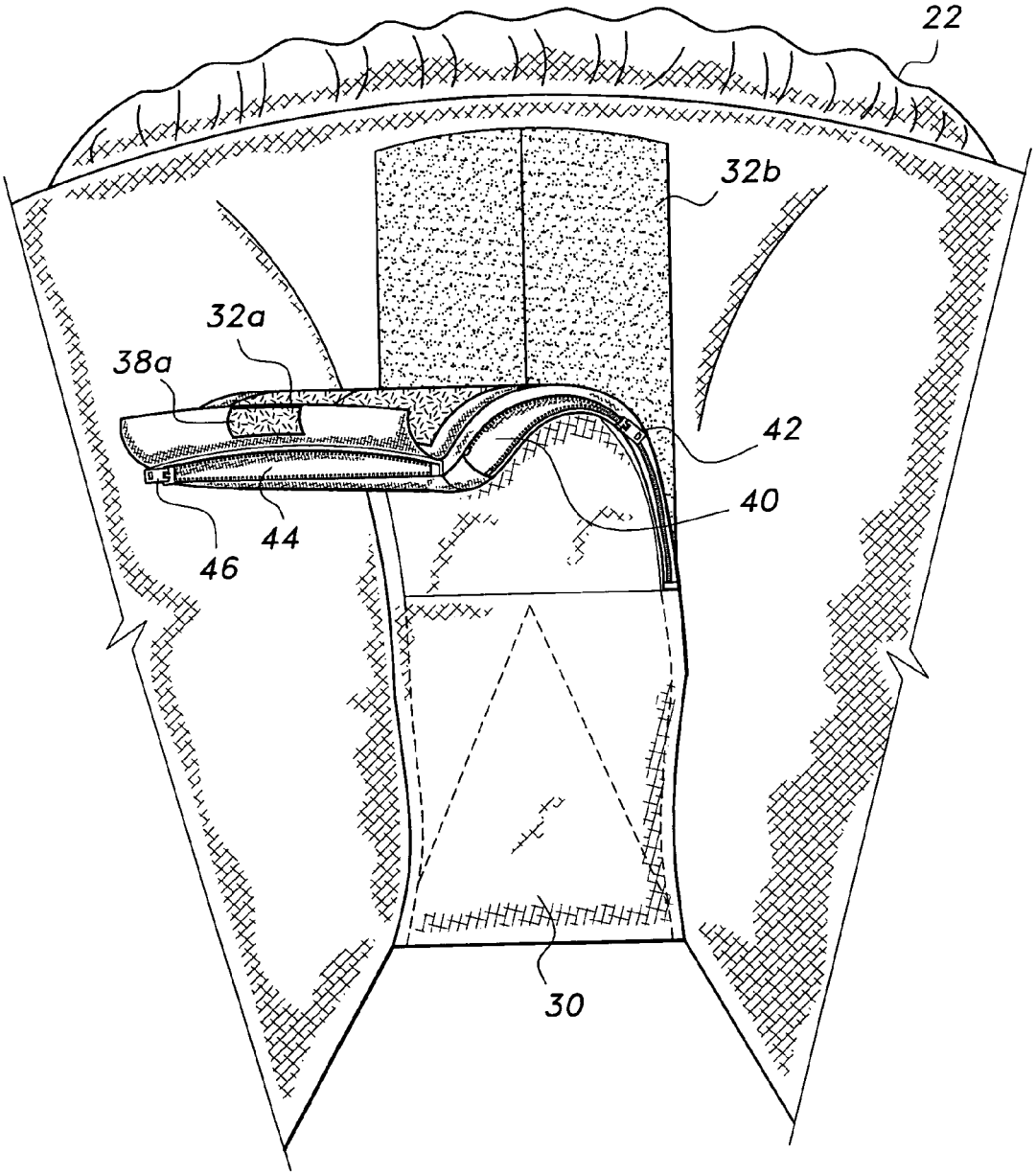
FIG. 5 is a fragmented perspective view of the unisex active wear garment of the present invention, showing details of the fly-flap.

Referring now to FIG. 5, it can be seen that pocket 40 opens laterally, while pocket 44 opens at the top. Pocket 40 includes fastener 42 disposed about the mouth of the pocket to seal vertical pocket 40 in a closed position. As seen in FIGS. 1 and 5, when garment 20 is being worn, with mating fasteners 32*a* and 32*b* engaged, pockets 40 and 44 will be positioned above crotch opening 36 (FIGS. 3 and 4). This results in pockets 40 and 44 being located above the wearer's crotch, and in front of the abdomen of the wearer. Pocket 40 is preferably made from waterproof material, or has a waterproof liner, in order to hold and keep items dry, such as toilet tissue, tampons, etc. Pocket 44 is accessible from the top of the fly-flap 30 and includes fastener 46 disposed about the mouth of the pocket 44 to seal the pocket 44 closed. Fasteners 42 and 46 are preferably zippers, but can also be hook and loop strips, buttons or snap members. Pockets 40 and 44 provide the wearer a convenient place to hold items such as toilet paper, identification cards, keys and snacks.

Pockets 40 and 44 may be formed, e.g., by a piece of fabric doubled over to form a front wall and a back wall. The back wall has its bottom edge and two lateral edges sewn to flap 30, thereby defining pocket 44, opening at the upper end 30*a* of flap 30. The front wall also has its bottom edge and one lateral edge sewn to flap 30, but the upper edge of the front wall is sewn to the upper edge of the back wall, thereby defining pocket 40, which opens laterally.

Figure 6:
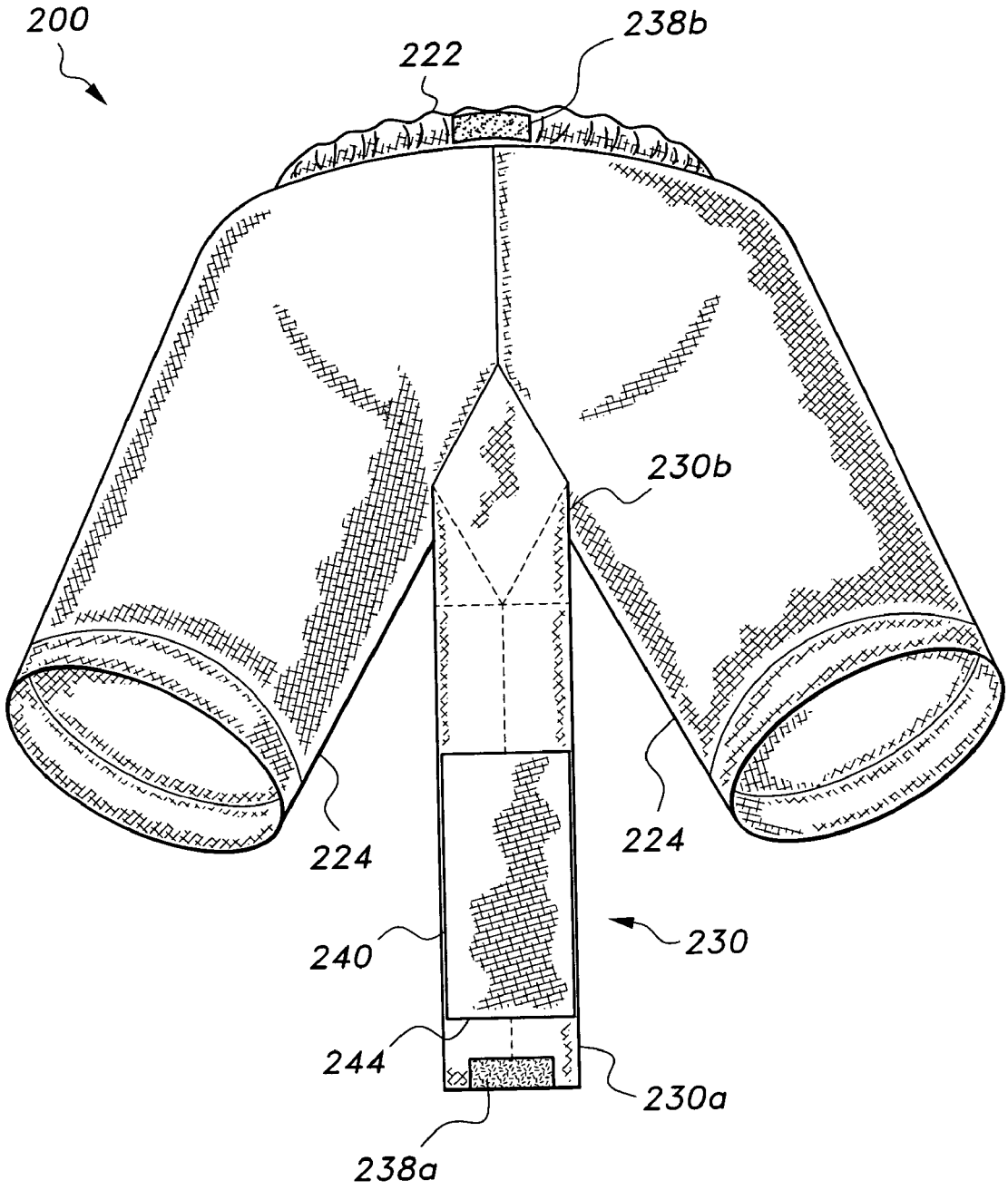
FIG. 6 is a front perspective view of an alternative embodiment of the unisex active wear garment with modified fly-flap and storage pockets according to the present invention shown in an open configuration.

FIG. 6 shows an alternative embodiment of an active wear garment of the present invention, designated generally as 200, in which the fly-flap 230 is fixed to the front of garment 200. The fixed end of the fly-flap 230*b* is secured to the front of garment 200 by sewing, and the releasably secured end of the fly-flap 230*a* is attached to the rear of the garment 200 by releasable fasteners. In use, the wearer uncovers the crotch opening by pulling the releasably secured end of fly-flap 230*a* away from the fastener found on the center-rear of the garment (not shown in FIG. 6) down between the legs 224 and up to the front of the garment 200. To maintain fly-flap 230 in an open position, the wearer attaches fastener 238*a*, disposed on the exterior of the free end of fly-flap 230*a*, to fastener 238*b*, which is disposed on the front of the garment 200 at the waistband 222. Fasteners 238*a* and 238*b* are preferably hook and loop strips but they can also be other material such as snap members or buttons. After the wearer has performed their bodily function, the wearer releases fastener 238*a* from fastener 238*b* and brings fly-flap 230 back to its original position on the rear of the garment. The fly-flap 230 includes top opening pocket 244 and laterally opening pocket 240, similar to pockets 44 and 40, respectively.

Figure 7:
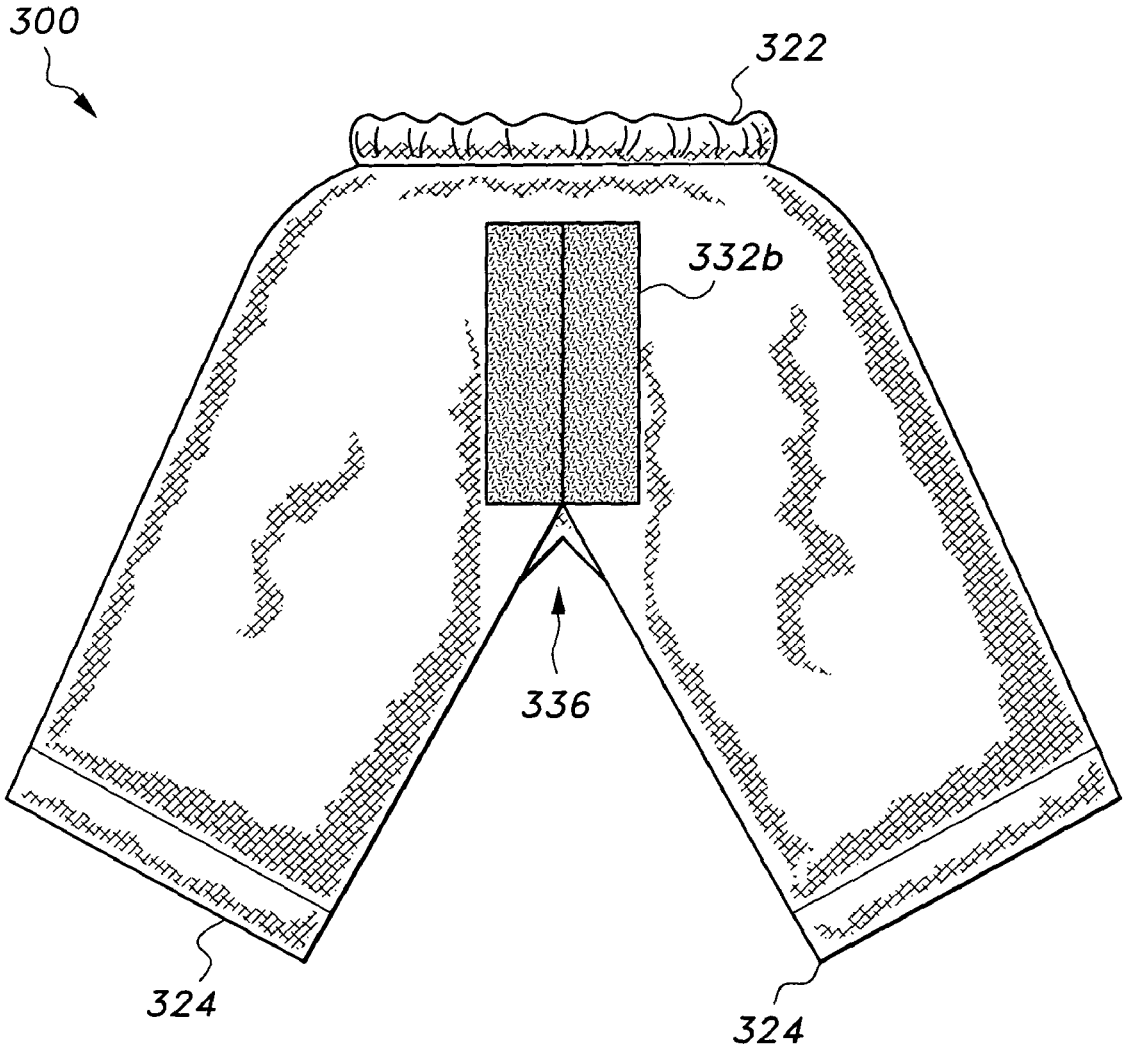
FIG. 7 is a front perspective view of another alternative embodiment of the unisex active wear garment showing the fly-flap completely removed from the garment.

Another alternative embodiment is illustrated in FIG. 7, which shows a front view of an active wear garment 300 that has a completely removable fly-flap 330. Garment 300 has waistband 322, legs 324, and crotch opening 336. In the present figure, fly-flap 330 is not shown, being completely removed from the garment 300. Fastener 332*b* is positioned in the center-front of garment 300. Though not shown, a symmetrical fastener 332*b* is also positioned in the center-rear of garment 300. Fastener 332*b* is preferably hook and loop material for quick release, but may also be any other releasable fastener, such as snap members or buttons.

Figure 8A:
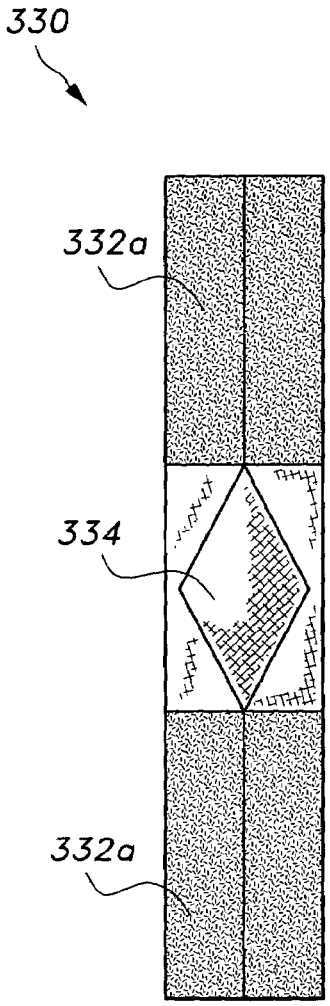
FIG. 8A is an elevation view showing the interior side of a fly-flap of the embodiment of FIG. 7.
Figure 8B:
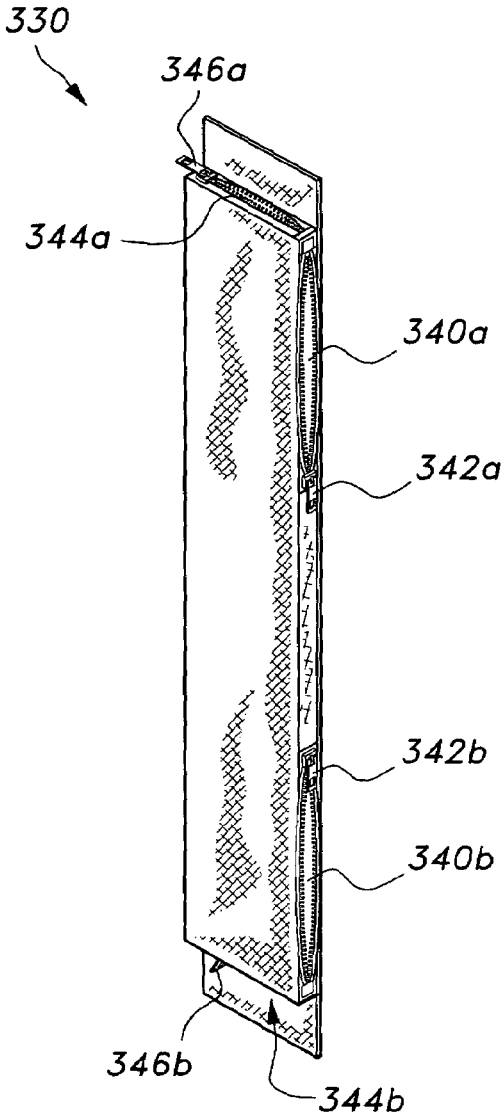
FIG. 8B is a perspective view showing the exterior side of the fly-flap of FIG. 8A.

FIGS. 8A and 8B show fly-flap 330 completely removed and separate from garment 300. Fly-flap 330 is an elongated, substantially rectangular strip or panel of material. FIG. 8A shows the interior side of fly-flap 330. FIG. 8A shows fastener 332*a* disposed at the opposite ends of fly-flap 330, and liner 334 disposed in the center thereof. When fly-flap 330 is replaced on top of the garment 300, fastener 332*a* is positioned to engage fastener 332*b* and liner 334 is positioned to cover crotch opening 336 to close the garment's opening and overlay the pubic area. Fasteners 332*a* and 332*b* are preferably hook and loop strips, but it can also be other releasable fasteners.

FIG. 8B shows the exterior side of fly-flap 330. Fly-flap 330 has four pockets, two laterally opening pockets 340*a* and 340*b*, and two pockets 344*a* and 344*b* opening towards the upper end and the lower end of flap 330, respectively. Pockets 340*a* and 340*b* are releasably closed by fasteners 342*a* and 342*b*, respectively; pockets 344*a* and 344*b* are releasably closed by fasteners 346*a* and 346*b*, respectively. Fasteners 342*a*, 342*b* and 346*a*, 346*b* are preferably zippers, but can also be hook and loop fastener strips, buttons or snap members. When the fly-flap 330 is positioned on the garment 300, the wearer has two pockets 340*a*, 344*a* at the upper end of the fly flap positioned on the front of the garment 300 and two pockets 340*b*, 344*b* at the lower end of the fly flap positioned on the rear of the garment. Garment 300, unlike garments 20 and 200, does not have corresponding fasteners 38*a*, 38*b* or 238*a*, 238*b* because here when the user desires to perform bodily functions, the entire fly-flap 330 is completely removed from garment 300.

It is to be understood that the present invention is not limited to the embodiments described above, but encompasses any and all embodiments within the scope of the following claims.

I claim:

1. A unisex active wear garment with modified fly-flap and storage pockets, comprising:

a torso section defining a waist opening, the torso section having a front and a rear;

a pair of legs extending from the torso section and defining leg openings, a crotch opening being defined in the torso section between the legs;

a fly-flap having a front surface, a rear surface, a lower end attached to the rear of the torso section and an upper end releasably attached to the front of the torso section;

said fly-flap further including a liner disposed on said rear surface, said liner being shaped and configured to align with and cover said crotch opening when the upper end of said fly-flap is attached to the front of the torso section;

mating sections of a releasable fastener attached to the rear surface of the upper end of said fly-flap and the front of said torso section, respectively;

the section of releasable fastener attached to the front of said torso section extending from said crotch opening to a point adjacent to said waist opening, and the section of releasable fastener attached to the rear surface of the upper end of said fly-flap extending from said liner to a point adjacent the end of said upper end; and at least one pocket attached to the front surface of the upper end of said fly-flap, said at least one pocket located opposite the section of releasable fastener attached to the rear surface of the upper end of said fly-flap;

such that when the garment is worn and the mating sections of the releasable fastener are engaged, said fly-flap upper end is attached to the front of said torso section, said upper end of said fly-flap extends to said point adjacent the waist opening, said liner covers said crotch opening, and the at least one pocket is positioned above the crotch opening adjacent the front of the torso section, said at least one pocket extending in front of the abdomen of the garment wearer.

2. The unisex active wear garment according to claim 1, wherein said releasable fastener comprises mating sections of hook and loop fastening material attached to said fly-flap and said torso section, respectively.

3. The unisex active wear garment according to claim 1, wherein said at least one pocket consists of a single pocket having an opening extending towards the waist of said torso section.

4. The unisex active wear garment according to claim 1, wherein said at least one pocket consists of a single pocket having an opening extending laterally towards one of said legs.

5. The unisex active wear garment according to claim 1, wherein said at least one pocket comprises a first pocket having an opening extending towards the waist of said torso section and a second pocket having an opening extending laterally towards one of said legs.

6. The unisex active wear garment according to claim 1, wherein said at least one pocket is made from waterproof material.

7. The unisex active wear garment according to claim 1, wherein said at least one pocket has an opening defined therein and a releasable fastener disposed about the opening for closing the pocket.

8. The unisex active wear garment according to claim 1, wherein said at least one pocket has an opening defined therein and a zipper fastener disposed about the opening for closing the pocket.

9. The unisex active wear garment according to claim 1, further comprising an elastic waistband disposed about the waist of said torso section.

10. The unisex active wear garment according to claim 9, wherein said point adjacent to said waist opening is between about one-half inch to one inch below said waistband.

11. The unisex active wear garment according to claim 1, wherein said torso section and said legs are made from spandex.

12. The unisex active wear garment according to claim 1, wherein the lower end of said fly-flap is sewn to the rear of said torso section.

13. The unisex active wear garment according to claim 1, wherein the lower end of said fly-flap is releasably attached to the rear of said torso section.

14. The unisex active wear garment according to claim 1, further comprising a second releasable fastener having mating sections attached to the rear of said torso section and to the front surface of the upper end said fly-flap, respectively;

whereby said fly-flap is drawn between said legs and temporarily attached to the rear of said torso section in order to expose the crotch opening for eliminating bodily waste.

15. The unisex active wear garment according to claim 14, wherein said second releasable fastener comprises mating patches of hook and loop fastening material.

16. The unisex active wear garment according to claim 1, wherein the lower end of said fly-flap is releasably attached to the rear of said torso section, and wherein said at least one pocket comprises two pockets, including a first pocket having an opening extending towards the upper end of said fly-flap, a second pocket having an opening extending laterally towards one of said legs on the upper end of said fly-flap; and the fly-flap including a third pocket at the lower end of the fly-flap and having an opening extending towards the lower end of said fly-flap, and a fourth pocket at the lower end of the fly-flap and having an opening extending laterally from the lower end of the fly-flap.

17. The unisex active wear garment according to claim 16, wherein each of said four pockets further comprises a zipper fastener disposed about the pocket opening.

* * * * *